US009625138B2

(12) United States Patent
Wang

(10) Patent No.: US 9,625,138 B2
(45) Date of Patent: Apr. 18, 2017

(54) LIGHTING DECORATION STRUCTURE

(71) Applicant: Hua-Cheng Pan, Tainan (TW)

(72) Inventor: Chih-Liang Wang, Tainan (TW)

(73) Assignee: Hua-Cheng Pan, Tainan (TW)

( * ) Notice: Subject to any disclaimer, the term of this patent is extended or adjusted under 35 U.S.C. 154(b) by 126 days.

(21) Appl. No.: 14/462,576

(22) Filed: Aug. 19, 2014

(65) Prior Publication Data

US 2016/0053979 A1 Feb. 25, 2016

(51) Int. Cl.

| | |
|---|---|
| ***F21L 4/00*** | (2006.01) |
| ***F21V 23/02*** | (2006.01) |
| ***F21S 9/02*** | (2006.01) |
| ***F21V 33/00*** | (2006.01) |
| *F21W 121/00* | (2006.01) |

(52) U.S. Cl.

CPC ..... *F21V 23/023* (2013.01); *F21S 9/02* (2013.01); *F21V 33/0036* (2013.01); *F21W 2121/00* (2013.01)

(58) Field of Classification Search

CPC . F21V 11/16; F21V 23/023; F21W 2121/008; F21S 10/002; F21S 10/005; F21S 9/02

USPC ..... 362/157

See application file for complete search history.

(56) References Cited

U.S. PATENT DOCUMENTS

| | | | | |
|---|---|---|---|---|
| 7,798,665 | B2 * | 9/2010 | Yang | A47B 95/02 362/101 |
| 8,197,084 | B2 * | 6/2012 | Dubois | F21L 4/027 362/120 |
| 2006/0203485 | A1 * | 9/2006 | Fu | H01H 13/83 362/237 |
| 2007/0147024 | A1 * | 6/2007 | Wu | A45B 3/04 362/102 |
| 2014/0268866 | A1 * | 9/2014 | Yang | G09F 19/00 362/605 |

* cited by examiner

*Primary Examiner* — Anh Mai
*Assistant Examiner* — Matthew Peerce
(74) *Attorney, Agent, or Firm* — Leong C. Lei

(57) ABSTRACT

A lighting decoration structure includes a decorating object and a functional object. The decorating object consists of a mask, which is in a hollow and transparent three-dimension form with an opening, and a power supply box, which is positioned at a side of the mask for sealing the opening and provided with a control circuit, an illuminator as electrically connected therewith and positioned inside the mask and a battery magazine at a side opposite to the illuminator. The functional object is securely positioned at a circumference of the decorating object. Thereby battery replacement is convenient because of the battery magazine positioned at a side of the mask while production yield rate is increased because of the functional object positioned at the decorating object.

9 Claims, 11 Drawing Sheets

LIGHTING DECORATION STRUCTURE

TECHNICAL FIELD OF THE INVENTION

The present invention is related to decoration, particularly a lighting decoration structure with a specific function.

DESCRIPTION OF THE PRIOR ART

An ordinary decoration structure with a specific function such as cork or napkin ring usually includes a decorating object and a functional object that the decorating object is likely an one-piece doll, animal or plant model and so on while the functional object is likely a cork, ring, knife or folk and so on to be securely provided at a side of the decorating object by adhesive, screw, embedding or as extended from the decorating object. The aforesaid structure is decorative but monotonous without variety.

Therefore lighting and visual effect are gradually employed in a concept of product design. Taking a cork as the functional object for illustrating a main structure includes a decorating object and a cork that it is an encapsulated power supply unit by injection molding. The cork is configured by the power supply unit provided at a side of the decorating object and inside the power supply unit a battery substrate, an illuminator or other actuating element via electricity supply are provided from the bottom up. However the components inside the power supply unit are easily damaged due to impact at assembly so as to reduce the production yield rate. Further the battery is positioned at the bottom inside the power supply unit such that the components above the battery must be removed in order to replace it resulting in difficulty of battery replacement.

SUMMARY OF THE INVENTION

An objective of the present invention is to increase production yield rate and resolve difficulty of battery replacement of the prior art. Therefore the present invention provides a lighting decoration structure mainly including a decorating object, which consists of a mask in a hollow and transparent three-dimension form with an opening and a power supply box as positioned at a side of the mask for sealing the opening and provided with a control circuit, an illuminator as electrically connected therewith and positioned inside the mask and a battery magazine at a side opposite to the illuminator, and a functional object, which is securely positioned at a circumference of the decorating object. Thereby battery replacement is convenient because the battery magazine is positioned at a side of the mask while production yield rate is increased because the functional object and the power supply box are respectively positioned at the decorating object without interference to each other.

DETAILED DESCRIPTION OF THE PREFERRED EMBODIMENTS

Figure 1:
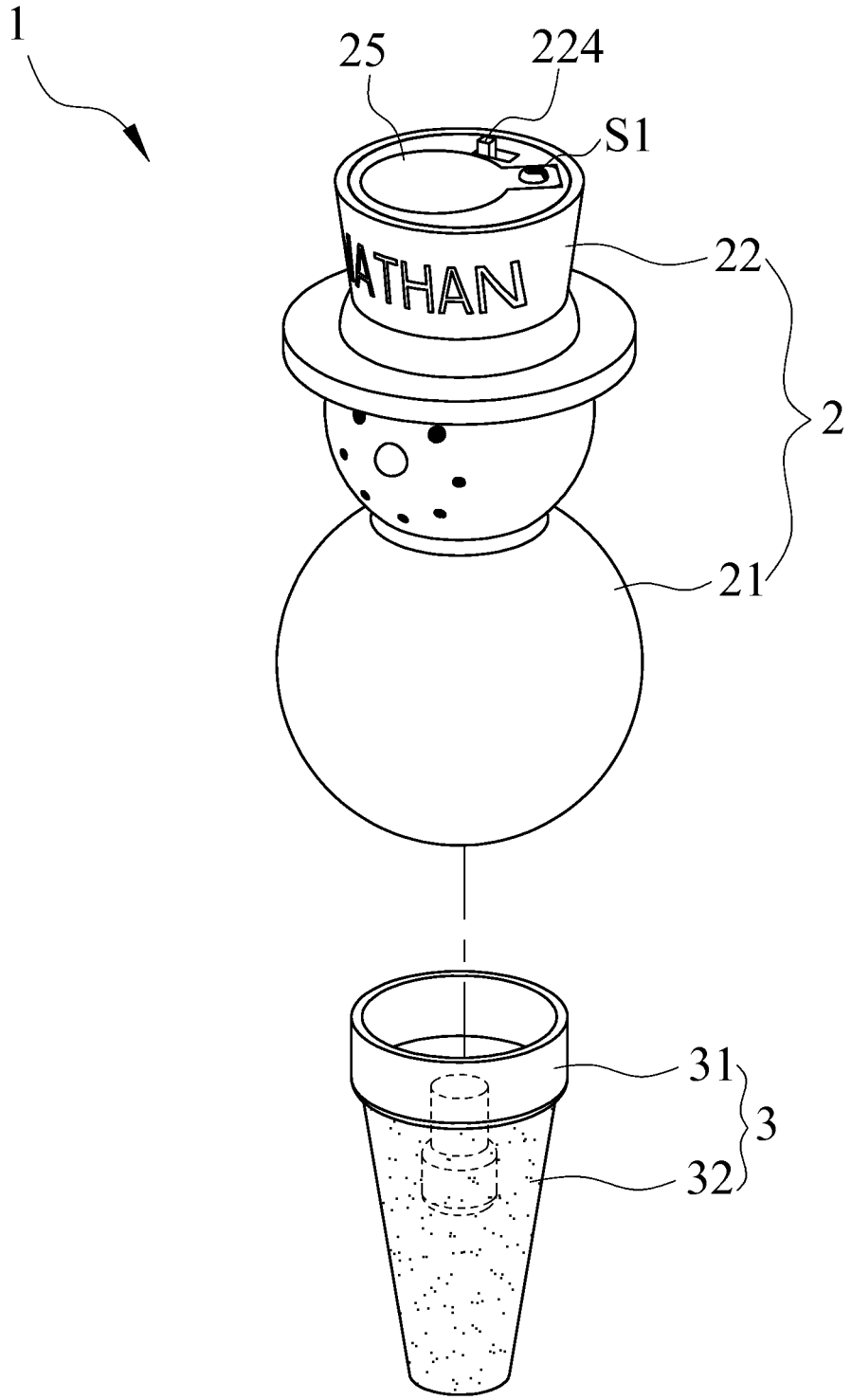
FIG. 1 is a schematic diagram illustrating a separation state of the present invention.
Figure 2:
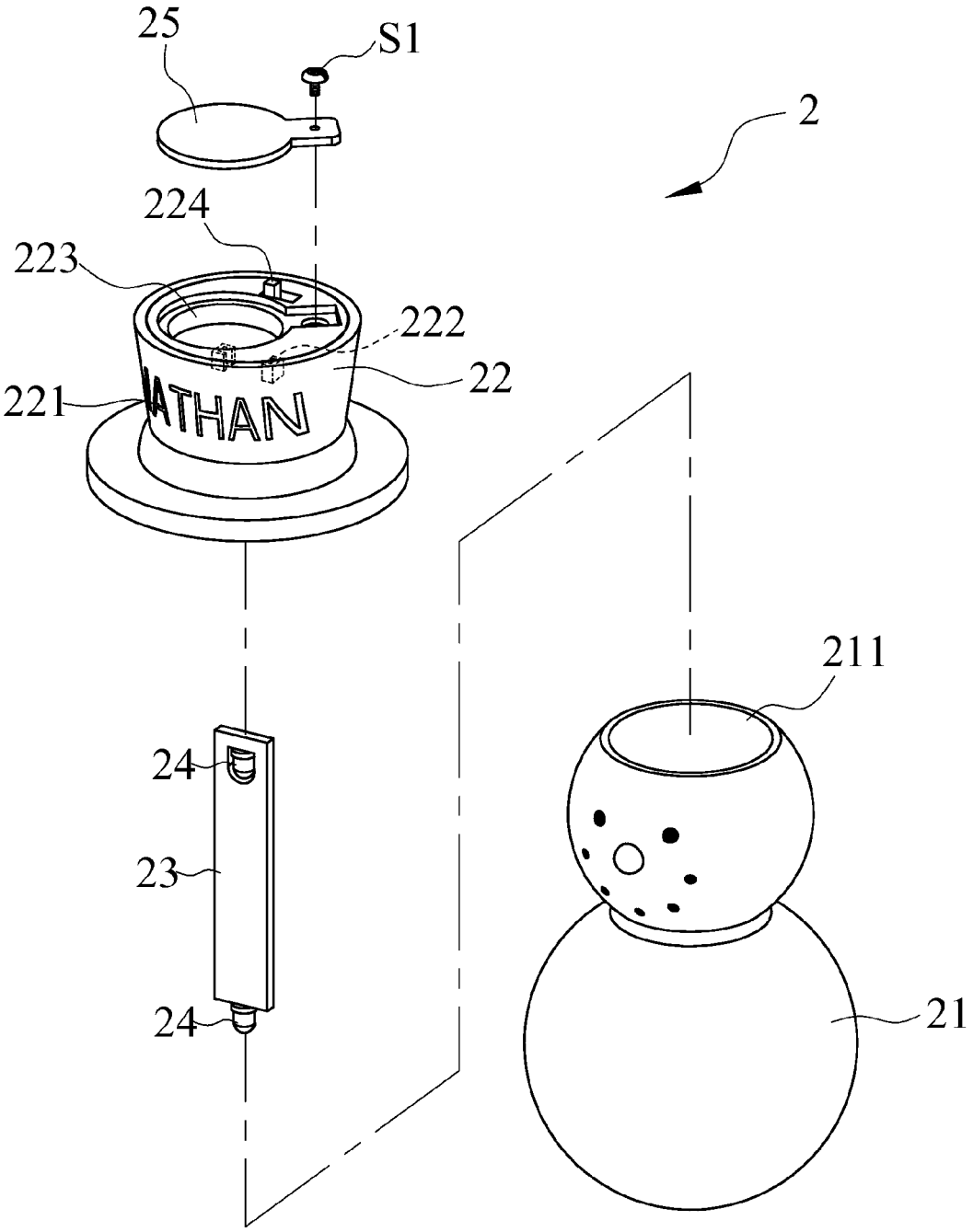
FIG. 2 is a schematic diagram illustrating a disassembly of a decorating object of the present invention.
Figure 3:
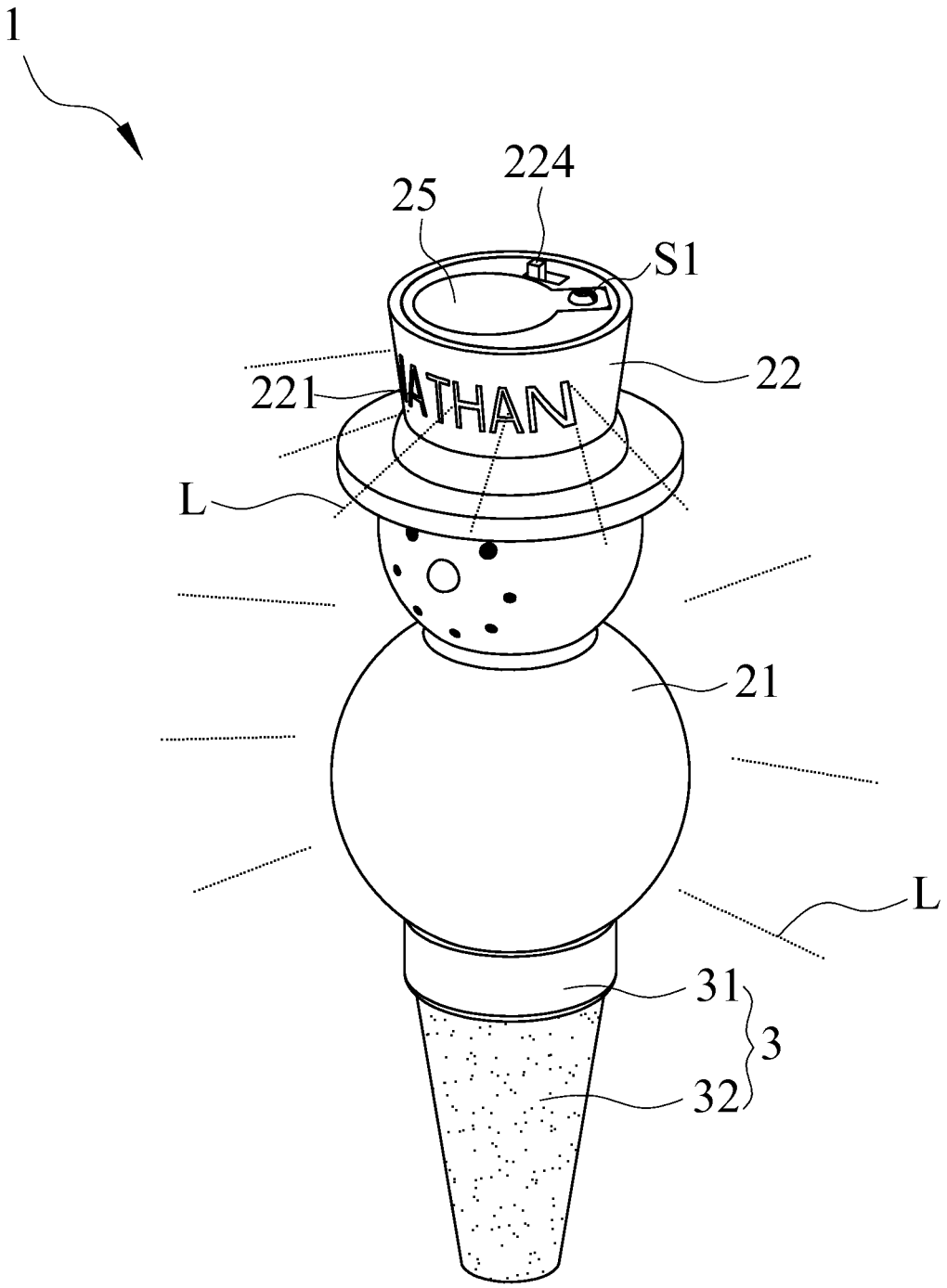
FIG. 3 is a schematic assembly diagram of the present invention.
Figure 4:
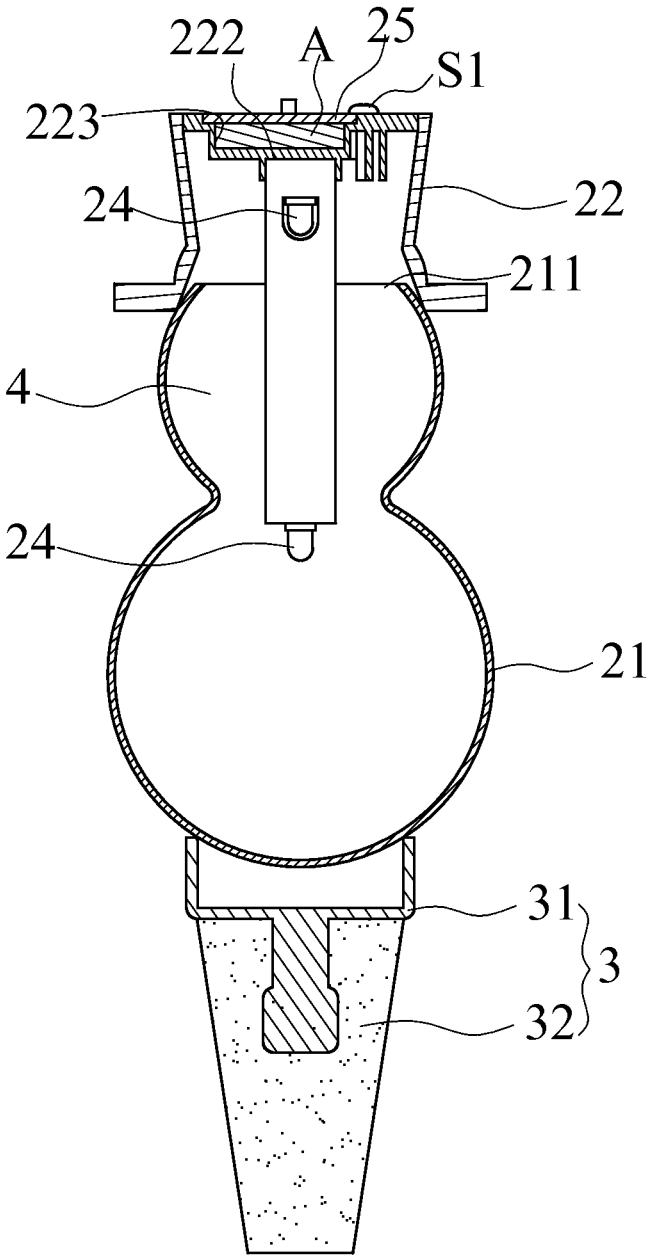
FIG. 4 is a schematic diagram illustrating a cross-section view of the present invention.

Please refer FIGS. 1 to 4 illustrating a lighting decoration structure (1) of the present invention that mainly includes a decorating object (2) and a functional object (3), which is securely positioned at a circumference of the decorating object (2).

The decorating object (2) consists of a mask (21) and a power supply box (22) that the mask (21) is in a three-dimension form of a snowman and the power supply box (22) is in a three-dimension form of a topper for illustration instead of limitation in this preferred embodiment. The mask (21) is hollow and transparent with an opening (211) at a top side while the power supply box (22) is positioned at the top side of the mask (21) for sealing the opening (211) so as to constitute a storing space (4) by both internal spaces of the power supply box (22) and the mask (21). A void area (221) is provided at a side wall of the power supply box (22) and the void area (221) is in a form of character or figure that character is shown for illustration purpose in this embodiment. The power supply box (22) is further provided with a control circuit (23) and two illuminators (24), each of which is electrically connected with the control circuit (23) and positioned inside the storing space (4) that one of the illuminators (24) is arranged inside the mask (21) and the other illuminator (24) is arranged with respect to the void area (221). Further a slot (222) is provided inside the power supply box (22) that an edge of the control circuit (23) is secured to the slot (222) while a battery magazine (223) in recess form is provided to a side wall inside the power supply box (22) opposite to the illuminator (24) for accommodating a battery (A). The power supply box is further provided with a switch (224) for controlling electricity supply and a cover (25) for sealing the battery magazine (223) by a screw (S1) onto the power supply box (22).

The functional object (3) is securely positioned at a bottom circumference of the mask (21) of the decorating object (2) so as to be separated from the power supply box (22). In this embodiment the functional object (3) is a cork, which includes a body (31) and a plug (32) as encapsulated on the body (31) and made of flexible substance. The functional object (3) is secured through the body (31) to a bottom of the mask (21) by one of the methods of adhesive, screw, embedding and so on.

Thereby, when the switch (224) is turned on to supply electricity, the light (L) emitted from each illuminator (24) will be passing through the void area (221) and the mask (21) for enhancing visual effect. Replacing battery (A) is convenient for the present invention because the battery magazine (223) of the power supply box (22) is arranged at the circumference. The power supply box (22) and the functional object (3) are respectively positioned at the separated locations of the mask (21) such that the problem of damaging components at assembly of the prior art is eliminated and thus production yield rate is increased.

Figure 5:
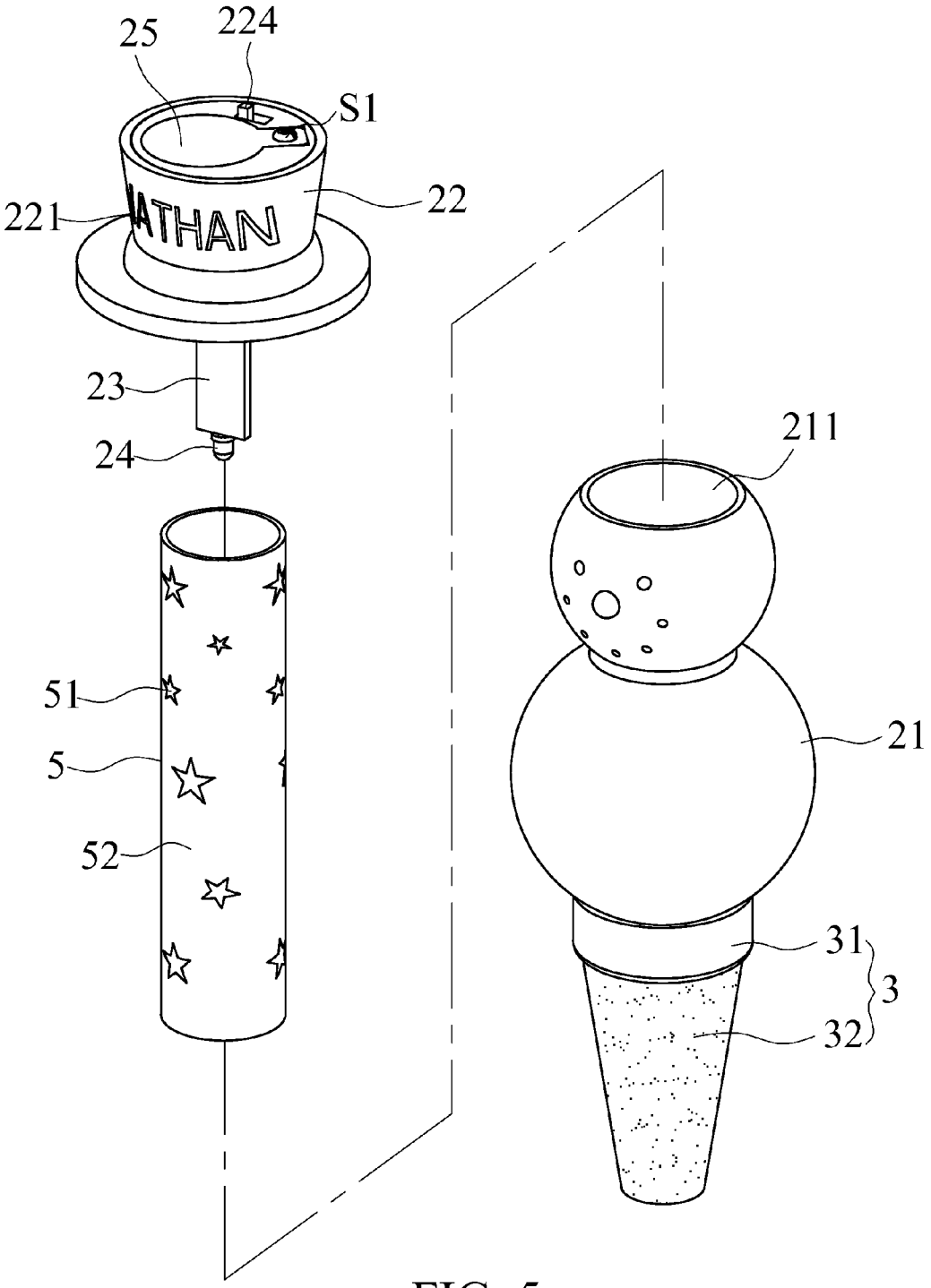
FIG. 5 is a schematic diagram illustrating a disassembly of a preferred embodiment of the present invention.
Figure 6:
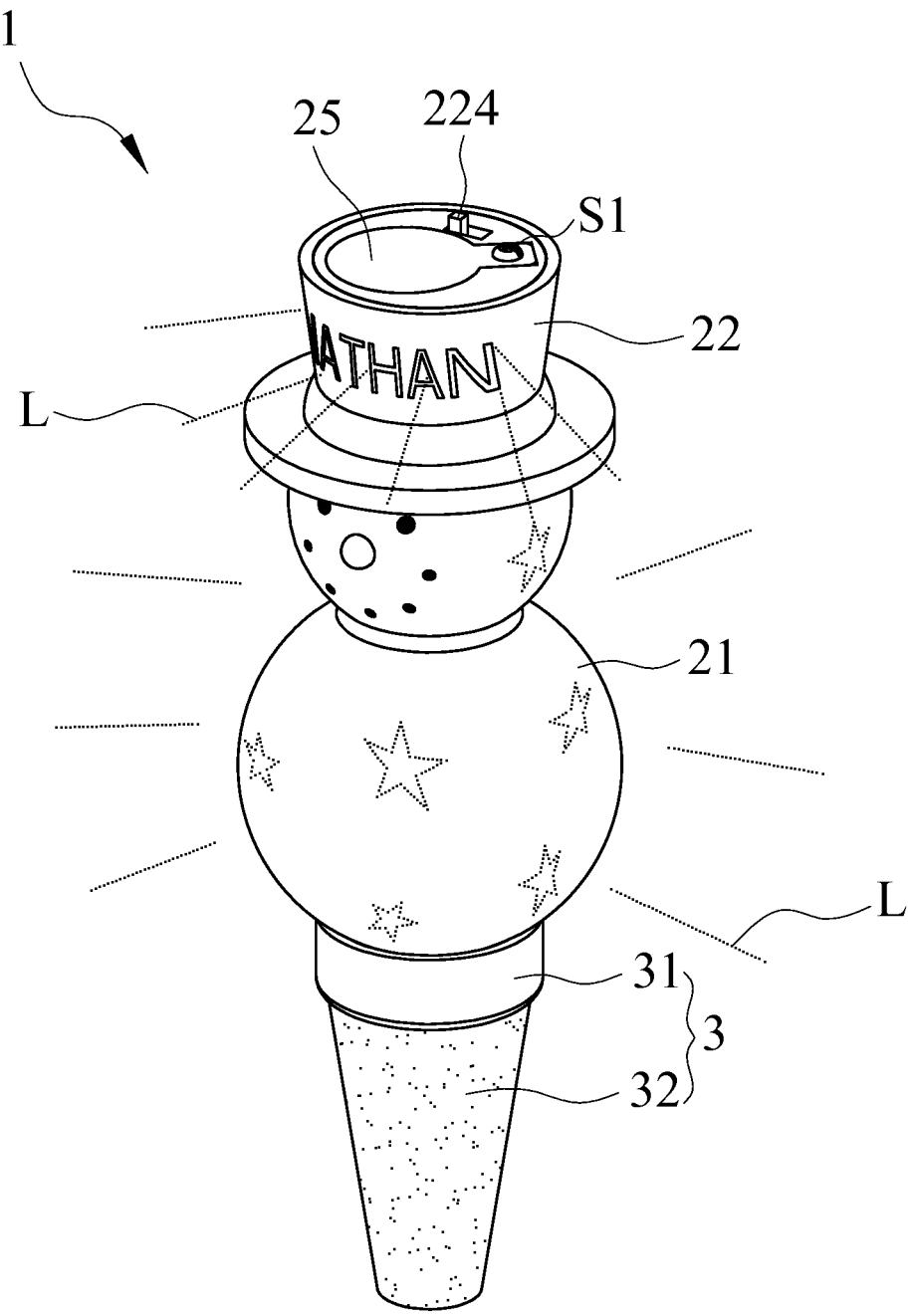
FIG. 6 is a schematic diagram illustrating the preferred embodiment of the present invention projecting light.
Figure 7:
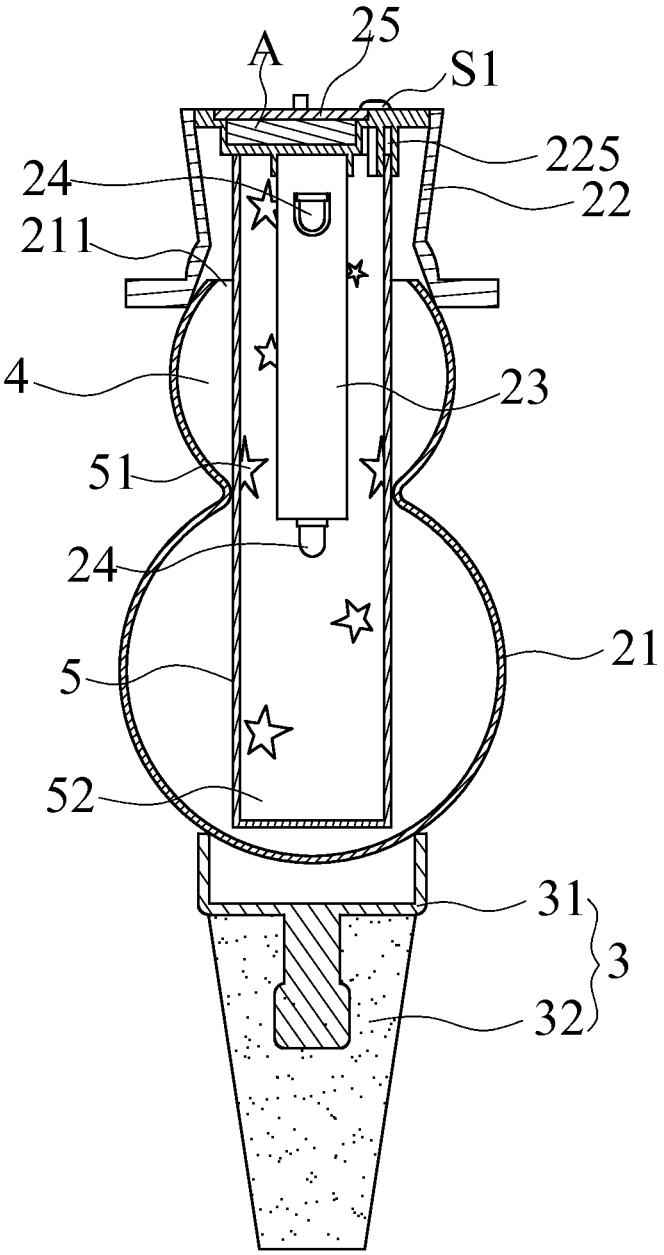
FIG. 7 is a schematic diagram illustrating a cross-section view of the preferred embodiment of the present invention.
Figure 8:
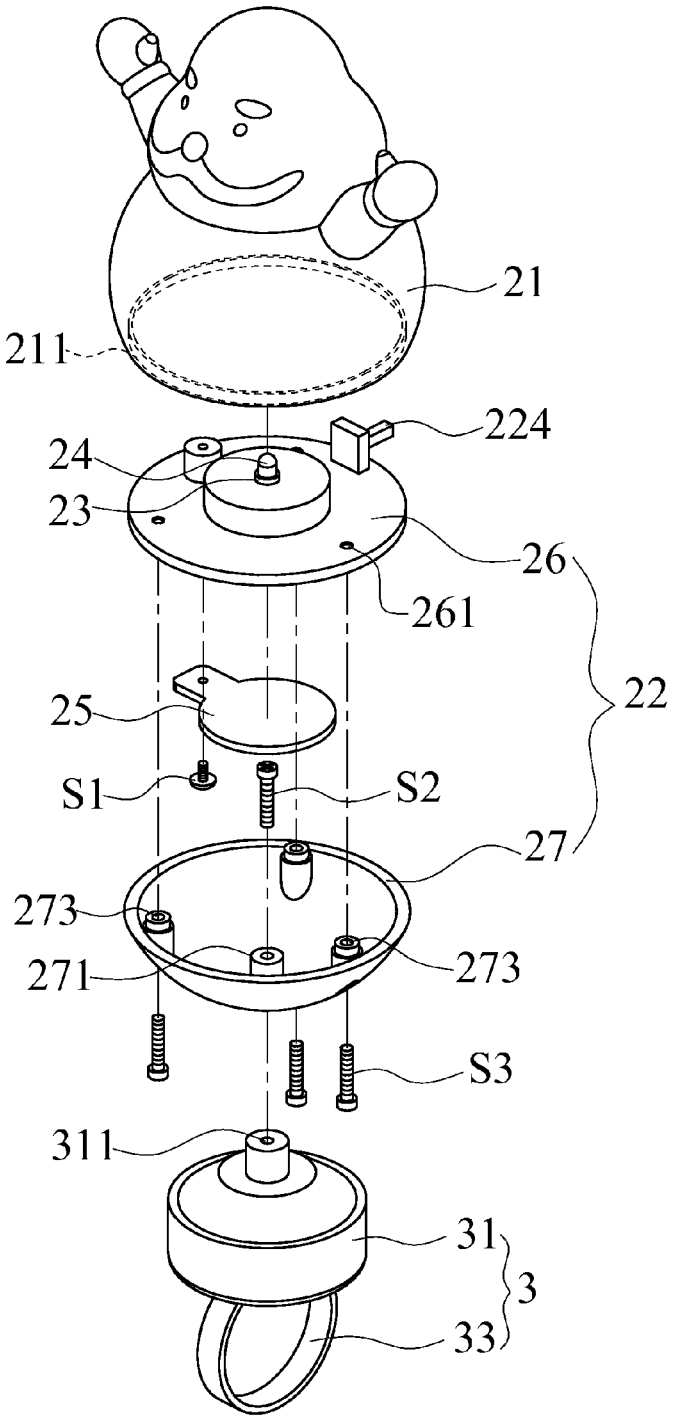
FIG. 8 is a schematic diagram illustrating a disassembly of the other preferred embodiment of the present invention.
Figure 9:
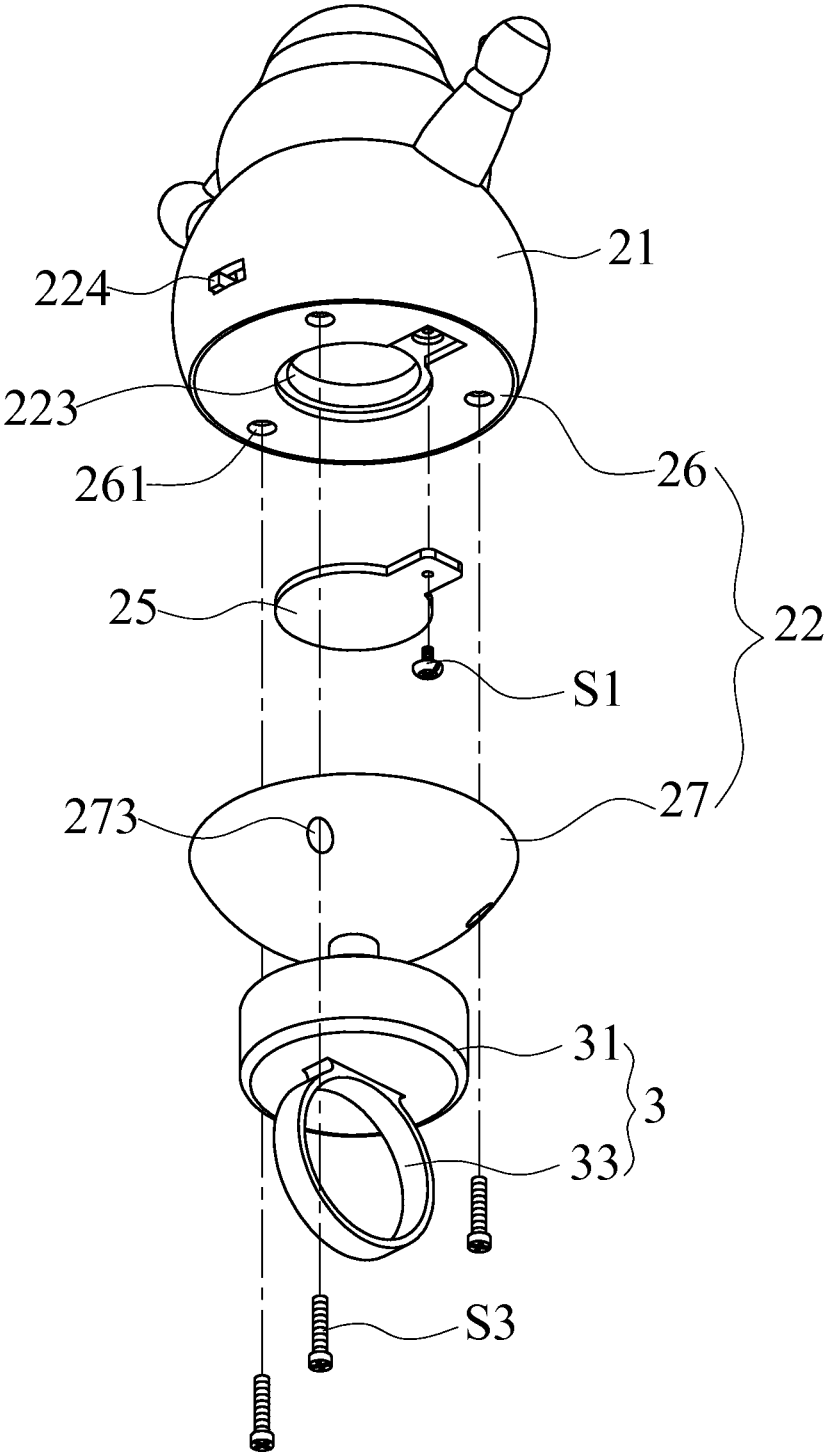
FIG. 9 is a schematic diagram illustrating the disassembly of FIG. 8 looking upward from bottom.
Figure 10:
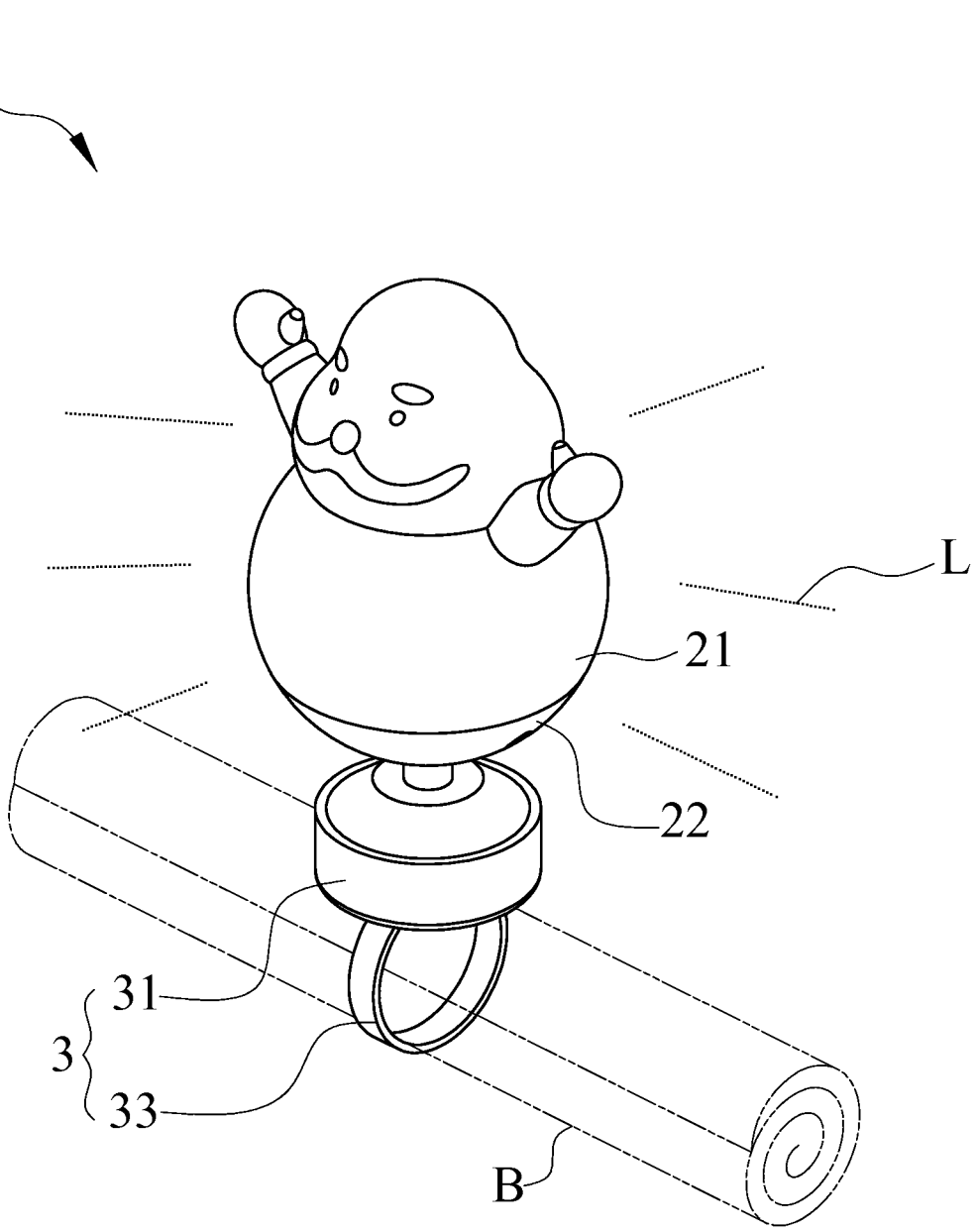
FIG. 10 is a schematic diagram illustrating the assembly of FIG. 8.
Figure 11:
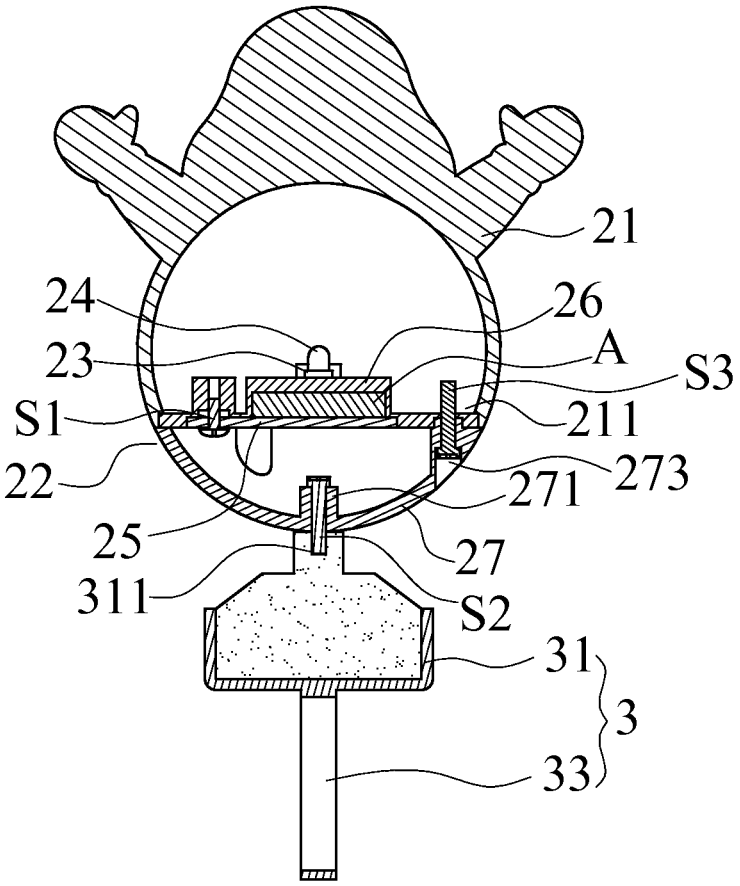
FIG. 11 is a schematic diagram illustrating a cross-section view of FIG. 8.

Please refer FIGS. 5 to 7 illustrating a disassembly, assembly and cross-section diagrams of the other embodiment of the present invention. The other embodiment further includes a projecting slide (5), which is in a cylinder form and encircles the illuminator (24), having an edge securely positioned inside the power supply box (22) by adhesive, clip or other means that in this embodiment the power supply box is provided with a slit (225) within which the projecting slide (5) is inserted. Further the projecting slide (5) is provided with a transparent area (51), which is in a form of character or figure, and an opaque area (52). The projecting slide (5) can be an ordinary flexible and transparent plastic film and the opaque area (52) can be made by color painting or other means on the projecting slide (5) while saving such color painting on some locations can produce the transparent area (51).

When the electricity is supplied, the light from the illuminator (24) with respect to the void area (221) will pass through it for lighting the void area (221). The light (L) from the illuminator (24) with respect to the mask (21) will pass through the transparent area (51) so as to project the contour of the transparent area (51) onto the mask (21) for enhancing a visual effect.

Please refer FIGS. 8 to 11 illustrating a disassembly, assembly and cross-section diagrams of another embodiment of the present invention that mainly includes a decorating object (2) and a functional object (3). The decorating object (2) consists of a mask (21) and a power supply box (22) that in this embodiment the mask (21) is in a form of doll for illustration purpose. The mask (21) is hollow and transparent and at its bottom provided with an opening (211). The power supply box (22) consists of a upper lid (26) and a lower lid (27) that the upper lid (26) is positioned at the bottom of the mask (21) for sealing the opening (211) while the illuminator (24) and the switch (224) of the power supply box (22) are positioned at the upper lid (26) inside the mask (21). The switch (224) partially extends out of the mask (21) for manipulation outside. The battery magazine (223) in recess form is provided at a side opposite to the illuminator (24) toward the mask (21) for accommodating a battery (A), which supplies electricity for the present invention. A cover (25) is further provided for sealing the battery magazine (223) by a screw (S1) onto the upper lid (26). The lower lid (27) is in a semi-sphere form and provided with a hole (271) at its bottom. In this embodiment the functional object (3) consists of a body (31) and a ring (33) that the ring (33) is positioned at a side of the body (31) while its opposite side with respect to the hole (271) of the lower lid (27) is provided with a locking hole (311). The functional object (3) is securely positioned to the lower lid (27) by a screw (S2) through the hole (271) and the locking hole (311).

The lower lid (27) is provided with multiply apertures (273) and the upper lid (26) is provided with multiply gaps (261) at the same quantity with respect to the multiply apertures (273). After the upper lid (26) is engaged to the mask (21), the cover (25) is engaged to the upper lid (26), and the lower lid (27) is engaged to the functional object (3), multiply screw (S3) are used to insert at an outer periphery of the lower lid (27) through the apertures (273) and the gaps (261) for assembling the lower lid (27) to the upper lid (26).

Thereby the ring (33) of the functional object (3) can be used to hang a napkin (B) or other objects. When the present invention is turned on, the light (L) from the illuminator (24) is projected to the mask (21) and passing through for constituting a decoration structure with a specific function. When battery (A) is to be replaced, first loosen the screw (S3) at the outer periphery of the lower lid (27) for separating the lower lid (27) and the upper lid (26) and then remove the cover (25) for battery replacement. Therefore the functional object (3) is not interfered for assembly and battery replacement that can not only eliminate the problem of damaging components of the prior art but also increase production yield rate.

I claim:

1. A lighting decoration structure comprising:

a decorating object comprising a mask and a power supply box, wherein the mask is in a hollow and transparent three-dimensional form that comprises a first interior space formed therein with an opening in communication therewith, and the power supply box comprises a second interior space formed therein and is positioned at a side of the mask for sealing the opening such that the second interior space is connected to and communicates with the first interior space to collectively define a storing space, which is provided therein with a control circuit board and two illuminators mounted to and electrically connected with the control circuit board; and the control circuit board is physically positioned in the storing space of the mask and the power supply box such that the control circuit board is mounted to the power supply box and extends from the power supply box into the mask with the two illuminators, one of the illuminators located in the power supply box and corresponding a side wall of the power supply, and another one of the illuminators located in the mask and corresponding a side wall of the mask to project light to the side walls of the power supply box and the mask respectively, and the power supply box provided with a battery magazine in recess form at a side opposite to the illuminator to receive and hold therein a power source in electrical connection with the control circuit board; and a functional object securely provided at a circumference of said decorating object and separated from the battery magazine of the power supply box;

a projecting slide is provided, encircling at least one of the illuminators and having an edge secured to the power supply box, and the projecting slide is configured with a transparent area and an opaque area.

2. The lighting decoration structure of claim 1 wherein said functional object is a cork or a ring.

3. The lighting decoration structure of claim 2 wherein said functional object is located at an outer circumference of said decorating object opposite to the power supply box.

4. The lighting decoration structure of claim 2 wherein said functional object is provided at a circumference of the power supply box of said decorating object and separated from the battery magazine.

5. The lighting decoration structure of claim 4 wherein the power supply box is provided with an upper lid and a lower lid and the illuminator and the battery magazine are positioned at the upper lid so as to seal the opening of the mask while the lower lid is securely positioned at the other side with respect to the upper lid with said functional object securely positioned at a periphery of the lower lid.

6. The lighting decoration structure of claim 1 wherein the side wall of the power supply box is provided with a void area and one of the illuminators that corresponds to the side wall of the power supply box is arranged to correspond to the void area.

7. The lighting decoration structure of claim 4 wherein the void area is in a form of character or figure.

8. The lighting decoration structure of claim 1 wherein the transparent area is in a form of character or figure.

9. The lighting decoration structure of claim 1 wherein the power supply box further includes a switch for controlling electricity supply and a cover for sealing the battery magazine.

* * * * *